US005350085A

United States Patent [19]

Kidd et al.

[11] Patent Number: 5,350,085

[45] Date of Patent: Sep. 27, 1994

[54] ADJUSTABLE ICE BIN

[75] Inventors: Robert P. Kidd, Prosper; Jerry A. Long, Carrollton, both of Tex.

[73] Assignee: Booth, Inc., Carrollton, Tex.

[21] Appl. No.: 28,232

[22] Filed: Mar. 9, 1993

[51] Int. Cl.[5] ..... B67D 5/62

[52] U.S. Cl. ..... 222/146.6

[58] Field of Search ..... 222/146.6; 62/389–400

[56] References Cited

U.S. PATENT DOCUMENTS 3,003,335 10/1961 Kattis .
3,019,612 2/1962 Jaeger .
3,021,686 2/1962 Alt .
3,224,641 12/1965 Morgan ..... 222/146.6 X
3,812,686 5/1974 Tester .
3,933,275 1/1976 Metzner et al. ..... 222/146.6 X
4,341,087 7/1982 Van Steenburgh, Jr. .
4,474,023 10/1984 Mullins, Jr. .
4,555,045 11/1985 Rodth et al. ..... 222/146.6 X
4,555,913 12/1985 Ishiguro .
4,577,473 3/1986 Ishiguro .
4,580,410 4/1986 Toya .
4,678,104 7/1987 Pritchett ..... 222/146.6
4,722,199 2/1988 Hibino .
4,958,505 9/1990 Swanson ..... 222/146.6 X
4,969,576 11/1990 Merrill et al. ..... 222/146.6 X
5,080,261 1/1992 Green ..... 222/146.6 X
5,226,296 7/1993 Kolvites et al. ..... 222/146.6 X
5,249,710 10/1993 Hassell et al. ..... 222/146.6

*Primary Examiner*—Andres Kashnikow
*Assistant Examiner*—Kenneth DeRosa
*Attorney, Agent, or Firm*—Harness, Dickey & Pierce

[57] ABSTRACT

A beverage dispenser for dispensing a beverage syrup or concentrate and a mixing liquid at a specified ratio has an ice bin which is divided into a front section and a rear section. A cold plate is located at the bottom of the front section. Either or both the mixing liquid or the beverage syrup or concentrate is circuitously routed through the cold plate prior to being dispensed. Portions of the rear section are partitioned off from the front section in order to reduce the total overall capacity of the ice bin. The partitioning of the rear section is accomplished by using shields which are located by flanges. The flanges extend inward from the walls of the ice bin into the front or rear sections of the ice bin.

19 Claims, 3 Drawing Sheets

ADJUSTABLE ICE BIN

FIELD OF THE INVENTION

The present invention relates to beverage dispensers. More particularly, the present invention relates to beverage dispensers which are designed to be combined with an ice storage bin wherein the dispensed beverage is cooled as it is being dispensed.

BACKGROUND OF THE INVENTION

The bottling industry supply beverage pre-mix supplies to restaurants, cafeterias, and other members of the retail sales industry who in turn use post mixing beverage dispensers to provide soft drinks for their customers. Typical post mixing dispensers are connected with a source of beverage syrup or concentrate, a source of water and a source of soda water either from a remote carbonator or the carbonator may be integrated into the beverage dispenser itself.

The supply of water and the supply of water for creating the soda water are normally obtained from the water which is piped to the building either from a municipal water department or from a well and thus the water is at a temperature that will vary according to the different environmental factors affecting the source of the water. The supply of beverage syrup or concentrate normally comes from some type of beverage syrup or concentrate container which is normally stored at room temperature. In order to provide a continuous supply of cold dispensed beverages, beverage dispensers have been developed which cool the components of the final beverage as they travel between their source and the dispensing nozzle.

The typical ice cooled beverage dispenser has an ice storage bin at the bottom of which is located a cold plate. A cold plate is normally aluminum having stainless steel tubing defining a circuitous route for each of the various beverage components traveling through it. When the ice bin is filled with ice, either manually or automatically, the ice chills the cold plate which in turn chills the beverage components as they each travel their circuitous route through the cold plate. By keeping the cold plate at a constant chilled temperature, the final dispensing temperature of the dispensed beverage can be maintained at a desirable level. In order to maintain the constant chilled temperature of the cold plate, the ice bins on these beverage dispensers need to be continuously refilled with ice. In addition to maintaining the chilled temperature of the cold plate, the supply of ice is also used, by most beverage dispensers, for the filling of beverage containers prior to the dispensing of the actual beverage. Thus, the volume of ice required is dependent upon the volume of beverages being dispensed both because of the chilling of the cold plate and the filling of the beverage containers. In order to minimize the amount of manual labor, some beverage dispensers are combined with an automatic ice maker.

One problem associated with beverage dispensers is the bridging of the ice within the ice bin. Bridging of the ice normally happens when the ice which is in contact with the cold plate remains undisturbed for an extended period of time. Bridging occurs when individual pieces of ice above the cold plate freeze together. When the ice in direct contact with the cold plate melts, pockets of air will form between the ice and the cold plate. The ice above the cold plate, which is now frozen together, is incapable of falling down to fill the air pockets. Thus, the amount of ice in contact with the cold plate is reduced. This bridging effect can significantly reduce the cooling ability of the beverage dispenser. In order to avoid bridging of the ice and to insure proper cooling of the cold plate, it is necessary that a continuous shifting of the ice within the bin be maintained. By continuously shifting the ice which is in contact with the cold plate, bridging of the ice is avoided and the cooling efficiency of the beverage dispenser is maintained insuring a dispensed beverage at a cooled constant temperature.

One method of keeping the ice moving is to balance the quantity of ice being used with the quantity of ice available. Then when the ice is used for filling the beverage containers prior to dispensing the beverage, the constant scooping action of the ice scooper into the supply of ice is normally enough movement to insure the elimination of bridging. However, when the quantity of ice available greatly exceeds the quantity of ice required, the action of filling the beverage containers will not disturb the ice located at the bottom of the ice bin which is in contact with the cold plate. This is because any used ice will be replaced prior to the ice level in the ice bin being reduced a sufficient amount for the beverage container filling action to effect the ice located at the bottom of the ice bin adjacent to the cold plate. It is therefore necessary to provide an ice bin storage capacity which is based upon the volume requirements of the individual user particularly when the ice is automatically supplied to the ice bin.

Prior art beverage dispensers utilize a constant volume ice bin. Because of the constant volume of ice being supplied, it is necessary to change beverage dispensers as the demand for the amount of dispensed beverages varies. The amount of ice required is directly related to the amount of beverages dispensed. The changing of the individual beverage dispensers to constantly match the volume of ice to the volume of dispensed beverages is a costly and time consuming process and requires the bottlers or supplier of the syrup or concentrate to keep a large quantity of the different ice capacity beverage dispensers on hand.

Accordingly, what is needed is a beverage dispenser which has the capability to quickly and efficiently vary the quantity of ice stored in the ice bin in response to the various demands which the customer places on the dispenser unit. In this way, the balance between the volume of ice and the volume of dispensed beverage can be easily maintained.

SUMMARY OF THE INVENTION

The present invention provides the art with a beverage dispenser which has an adjustable ice bin feature. The beverage dispenser has at least one shield which fits into multiple molded slots in the ice bin to vary the capacity of the ice bin and thus enable the user to maintain the balance between the volume of ice and the volume of dispensed beverages.

Other advantages and objects of the present invention will become apparent to those skilled in the art from the subsequent detailed description, appended claims and drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
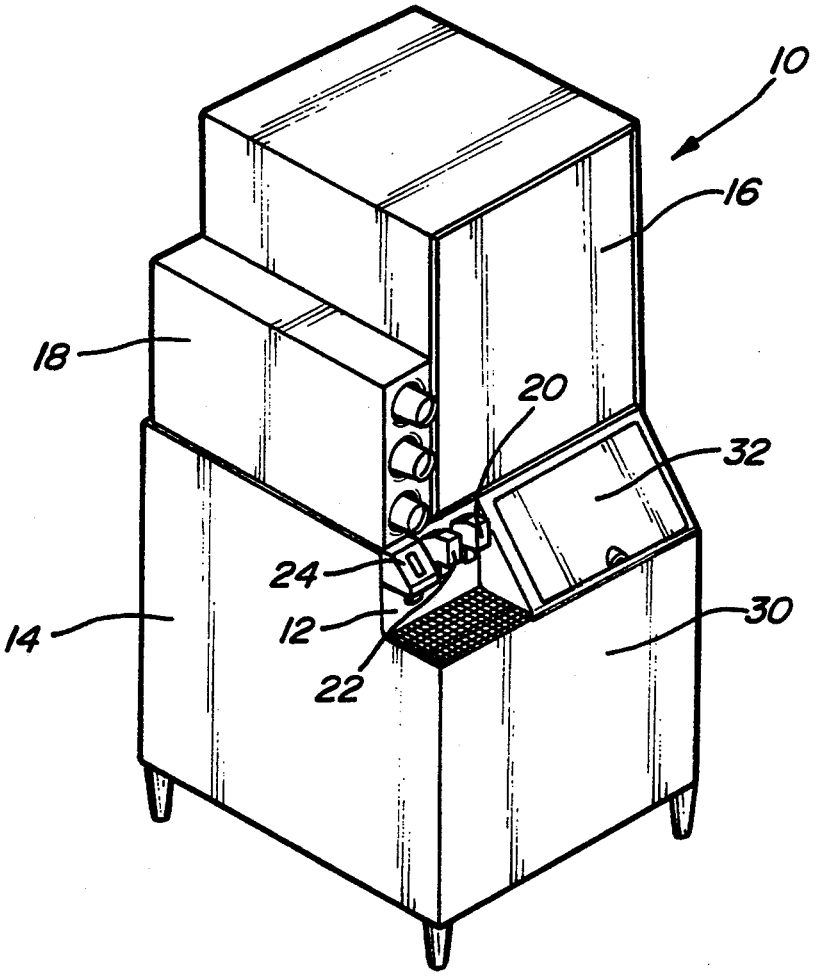
FIG. 1 is a perspective view of the beverage dispenser of the present invention equipped with an automatic ice maker and beverage container dispenser.
Figure 2:
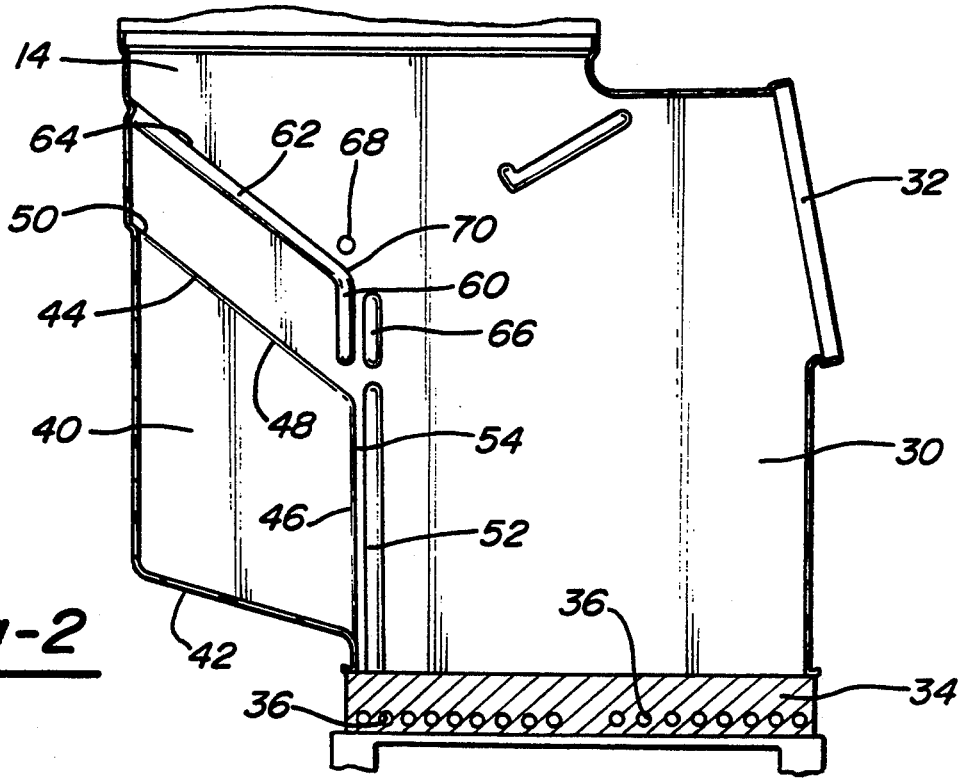
FIG. 2 is a longitudinal side view in cross section of the beverage dispenser of the present invention showing the adjustability of the ice bin.
Figure 3:
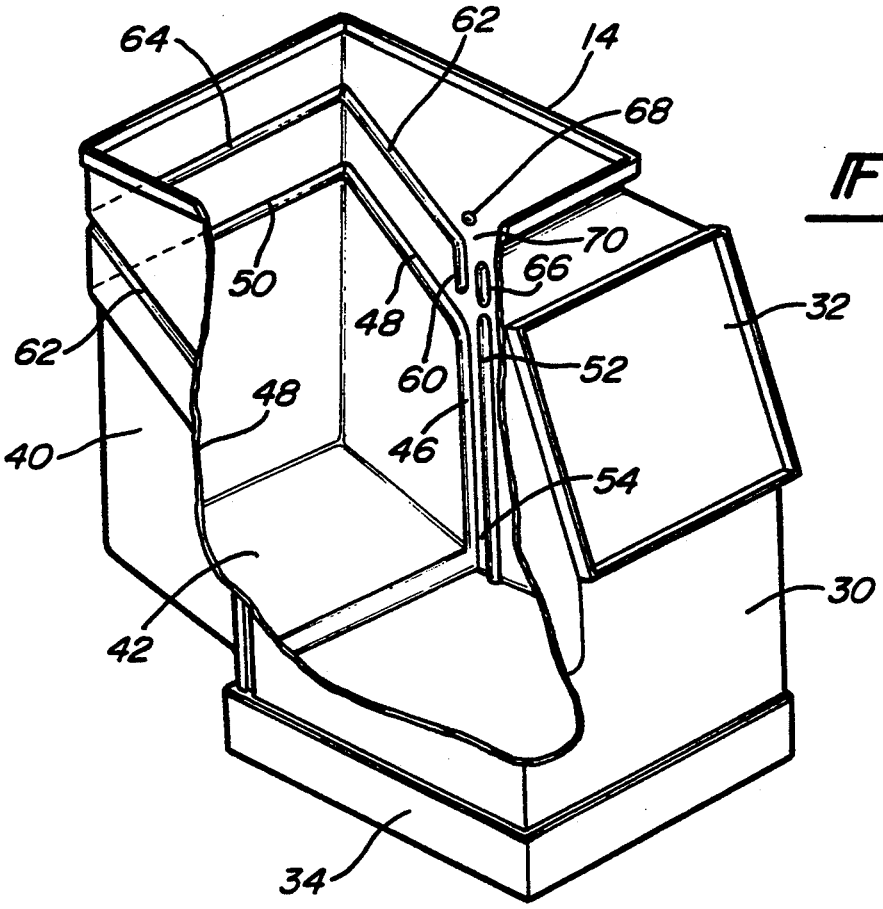
FIG. 3 is a perspective view partially cut away of the beverage dispenser of the present invention showing the ice bin equipped to accommodate a full capacity of ice.

Referring now to the drawings in which like reference numerals designate like or corresponding parts throughout the several views, there is shown in FIGS. 1 through 5 a beverage dispenser in accordance with the present invention which is designated generally by the reference numeral 10. Beverage dispenser 10 comprises a beverage dispensing station 12 and an ice bin 14. Beverage dispenser 10 is shown in FIG. 1 incorporating an optional automatic ice maker 16 and an optional cup dispenser 18. Automatic ice maker 16 can be any commercially available automatic ice maker which is capable of being fitted with beverage dispenser 10.

Beverage station 12 includes a pair of single flavor dispensing heads 20 and 22 as well as a programmable multi-flavor dispensing head 24. Dispensing head 24 can be equipped to supply a multiple number of beverage flavors if desired.

Ice bin 14 comprises a generally rectangular box container 30 having an access door 32 located adjacent beverage station 12 to provide simple access to the ice supply within ice bin 14 for the individual dispensing the beverage. The bottom of ice bin 14 is open and is sealingly secured to a cold plate 34. Cold plate 34 has a plurality of circuitously routed tubes 36 for supplying water, soda water and beverage syrup or concentrate to dispensing station 12. The plurality of tubes 36 are connected at their inlet end to the supply of water, soda water and the various flavors of beverage syrup or concentrate by a plurality of hoses (not shown). The plurality of tubes 36 are connected at their outlet end to dispensing station 12 also by a plurality of tubes (not shown). When ice bin 14 is filled with ice, cold plate 34 is operative to cool the water, soda water and various flavors of syrup or concentrate as they travel through cold plate 34 by transferring the excess heat within the components to the ice within the bin through cold plate 34. This insures a consistent temperature of dispensed beverage.

The rear section 40 of ice bin 14 has a separate bottom 42 which is angled from the rear of ice bin 14 downward towards cold plate 34 such that any ice located on bottom 42 would have a tendency to fall towards cold plate 34. The interior walls of rear section 40 are equipped with an inwardly disposed seat 44. Inwardly disposed seat 44 has a pair of opposing vertical flanges 46 extending generally vertical from the bottom of ice bin 14. There is one vertical flange 46 on each sidewall of ice bin 14. A pair of opposing angular flanges 48 begin at the top of vertical flanges 46 and extend angularly upward from the front of rear section 40 to the back wall of rear section 40. There is one angular flange 48 located on each side wall of rear section 40 and they are disposed generally parallel to each other. A generally horizontal flange 50 located on the back wall of rear section 40 connects the ends of angular flanges 48 which are adjacent the back wall of rear section 40. A second pair of opposing vertical flanges 52 extend generally vertical from the bottom of ice bin 14. There is one vertical flange 52 on each side wall of ice bin 14. Vertical flanges 52 are spaced from and generally parallel to vertical flanges 46 such that a vertical slot 54 is formed between both pairs of flanges 46 and 52. Vertical flanges 52 extend upward slightly higher than the intersection between vertical flanges 46 and angular flanges 48.

Figure 4:
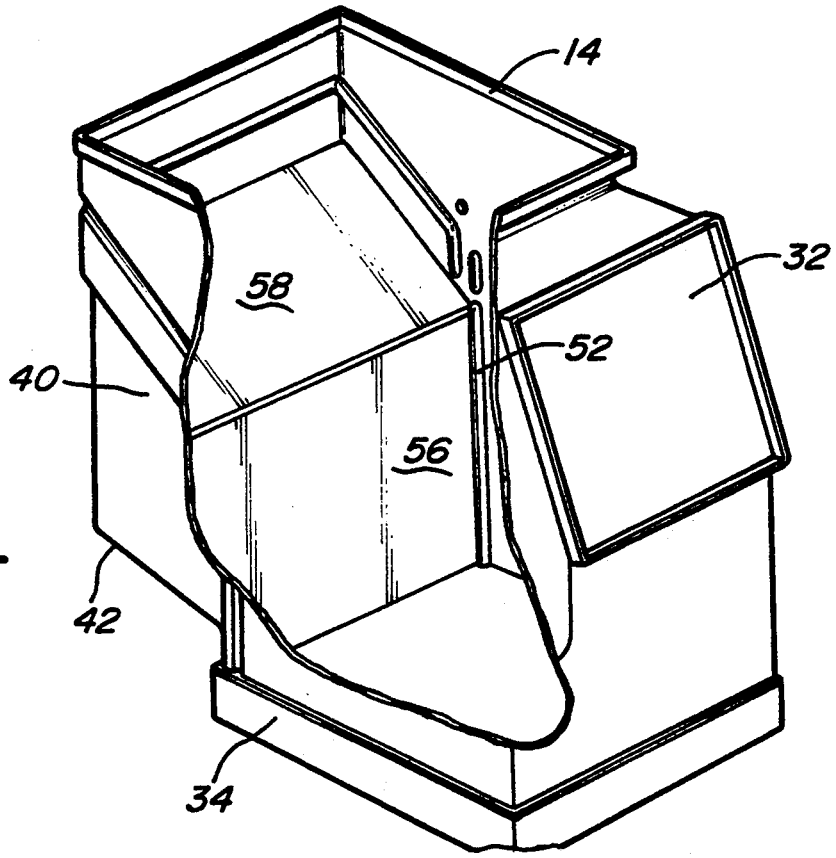
FIG. 4 is a perspective view partially cut away of the beverage dispenser of the present invention showing the ice bin equipped to accommodate a reduced capacity of ice.

Referring now to FIG. 4, ice bin 14 is shown in its first reduced ice volume capacity. A plastic shield 56 is positioned within vertical slots 54 to limit the access to rear portion 40 of ice bin 14. A second plastic shield 58 is placed on top of angular flanges 48 to prohibit ice from entering rear section 40 of ice bin 14 from above. Second plastic shield 58 rests on angular flanges 48 and is prohibited from sliding off of angular flanges 48 by contact with vertical flanges 52. The angular disposition of second plastic shield 58 allows for ice stored on the top of shield 58 to fall into the main portion of ice bin 14. When ice bin 14 is configured in this condition, the volume of ice is significantly reduced while the area of contact with cold plate 34 for cooling the beverages remains constant.

The interior walls of rear section 40 further have an additional pair of opposing vertical flanges 60 extending generally vertical to the bottom of ice bin 14. There is one vertical flange 60 on each side wall of ice bin 14 beginning a spaced distance above vertical flanges 46 and extending upward towards the top of ice bin 14. An additional pair of opposing angular flanges 62 begins at the top of vertical flanges 46 and extend angularly upward from the front of rear section 40 to the back wall of rear section 40. There is one flange 48 located on each side wall of rear section 40 and they are disposed generally parallel to each other as well as generally parallel to angular flanges 48. A generally horizontal flange 64 located on the back wall of rear section 40 connects the ends of angular flanges 48 which are adjacent the back wall of rear section 40. A second additional pair of opposing vertical flanges 66 extend generally vertical to the bottom of ice bin 14. There is one vertical flange 66 on each side wall of ice bin 14 beginning a spaced distance above vertical flanges 52 and extending upwards towards the top of ice bin 14. Vertical flanges 66 are spaced from and generally parallel to vertical flanges 60 such that an extension to vertical slot 54 is formed between both pairs of flanges 60 and 66. A generally circular detent 68 is positioned slightly above each end of angular flanges 62 adjacent vertical flanges 60 to form a pair of second slots 70 which are used to locate second plastic shield 58 as will be described later herein.

Figure 5:
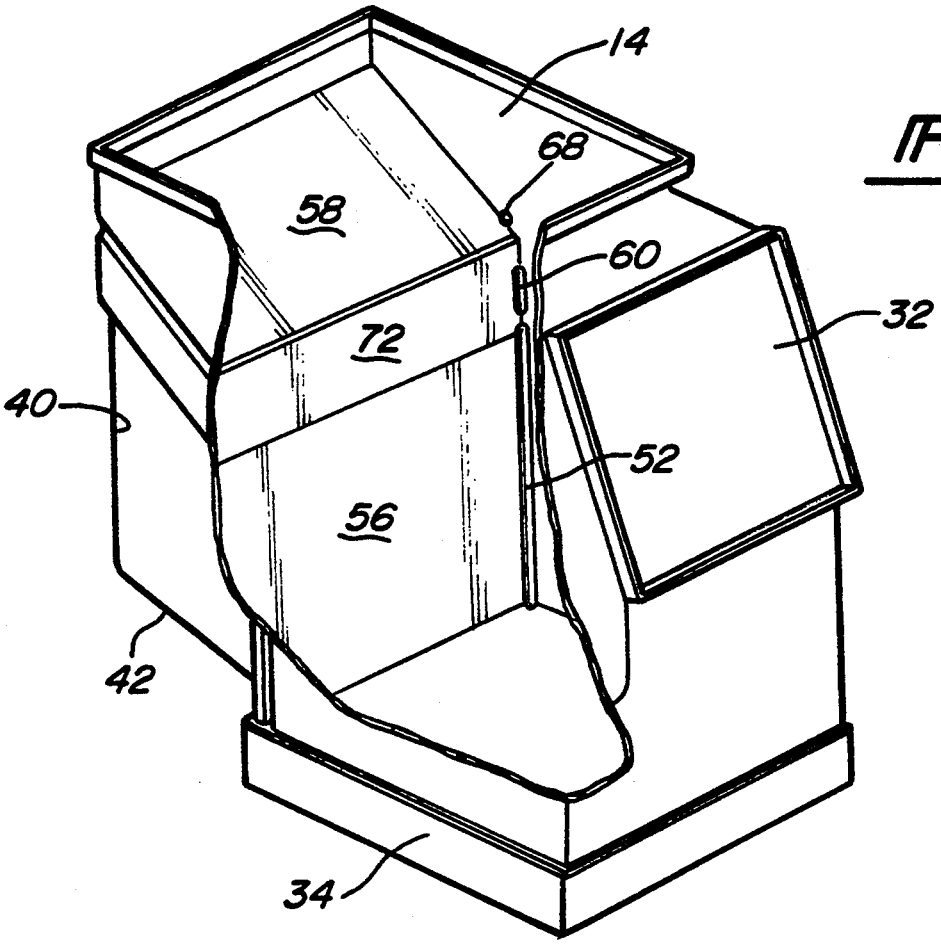
FIG. 5 is a perspective view partially cut away of the beverage dispenser of the present invention showing the ice bin equipped to accommodate a further reduced capacity of ice.

Referring now to FIG. 5, ice bin 14 is shown in its second reduced ice volume capacity. Plastic shield 56 is positioned within vertical slots 54 to limit the access to rear portion 40 of ice bin 14. A third plastic shield 72 is positioned on top of plastic shield 56 within the extension of slots 54 formed by vertical flanges 60 and 66 to further limit the access to rear portion 40 of ice bin 14.

Second plastic shield 58 is placed on top of angular flanges 62 and within slot 70 to prohibit the ice from entering rear section 40 of ice bin 14 from above. Second plastic shield 58 rests on angular flanges 62 and within slot 70 and is prohibited from sliding off of angular flanges 62 by contact with third plastic section 72. Again, the angular disposition of second plastic shield 58 allows for ice stored on the top of shield 58 to fall into the main portion of ice bin 14. When ice bin 14 is configured in this condition, the volume of ice is reduced a second time by the addition of third plastic shield 72 while the area of contact with cold plate 34 for cooling the beverages remains constant.

Thus, the ice bin of the present invention is capable of being configured such that three different amounts of ice can be stored in the bin by simply arranging the respective plastic shields. The plastic shields are easily removed for cleaning or reconfiguration. The adjustability of the amount of ice within the ice bin allows the bottler or the supplier of the syrup or concentrate to supply the same beverage dispensing unit to beverage accounts having various volume requirements. This adjustable feature also allows beverage accounts to grow in volume without requiring the bottler or the syrup or concentrate supplier to change the dispensing equipment. In addition, quick and simple volume adjustments can be made to tailor the dispensing unit to seasonal variations in beverage dispensing volume.

While the present invention has been shown having three different volume capacities for ice, it is to be understood that more or less than three volume capacities of ice could be offered by providing appropriate positioned flanges and plastic shields.

While the above detailed description describes the preferred embodiment of the present invention, it should be understood that the present invention is susceptible to modification, variation and alteration without deviating from the scope and fair meaning of the subjoined claims.

What is claimed is:

1. A beverage dispenser for dispensing a beverage concentrate and a mixing liquid at a specified ratio, said beverage dispenser comprising:

an ice bin defining an ice storage cavity;

means for cooling said mixing liquid prior to the dispensing of said mixing liquid, said means for cooling said mixing liquid in communication with said ice storage cavity over a first predetermined surface area, said first predetermined surface area comprising substantially the entire surface area of said means for cooling said mixing fluid; and means for reducing the volume of said ice storage cavity of said ice bin, said means for reducing the volume of said ice storage cavity operable to maintain said communication between said first predetermined surface area and said ice storage cavity while reducing the volume of said ice storage cavity.

2. The beverage dispenser of claim 1 further comprising means for cooling said beverage concentrate prior to the dispensing of said beverage concentrate, said means for cooling said beverage concentrate in communication with said ice storage cavity of said ice bin.

3. The beverage dispenser of claim 2 wherein said means for cooling said beverage concentrate is in communication with said ice storage cavity over a second predetermined surface area, said second predetermined surface area comprises substantially the entire surface area of said means for cooling said beverage concentrate, and said means for reducing the volume of said ice storage cavity is operable to maintain said second predetermined surface area in communication with said ice storage cavity while reducing the volume of said ice storage cavity.

4. The beverage dispenser of claim 2 wherein said means for cooling said beverage concentrate is a cold plate disposed at the bottom of said ice storage cavity, said beverage concentrate being circuitously routed through said cold plate prior to being dispensed.

5. The beverage dispenser of claim 1 wherein said ice storage cavity comprises a front section and a rear section, said rear section being in communication with said front section, said front section being in communication with said means for cooling said mixing liquid.

6. The beverage dispenser of claim 5 wherein said means for reducing the volume of said ice storage cavity selectively limits the amount of said rear section which is in communication with said front section.

7. The beverage dispenser of claim 5 wherein said means for reducing the volume of said ice storage cavity comprises:

at least one shield disposed between said front section and a portion of said rear section;

a cover for isolating said portion of said rear section from said front section.

8. The beverage dispenser of claim 7 wherein said at least one shield is held in position by a plurality of flanges extending from the walls of said ice bin into said ice storage cavity.

9. The beverage dispenser of claim 7 wherein said cover is held in position by a plurality of flanges extending from the walls of said ice bin into said ice storage cavity.

10. The beverage dispenser of claim 1 further comprising a door for providing access to said ice storage cavity.

11. The beverage dispenser of claim 1 wherein said ice storage cavity is adapted to mate with an automatic ice maker.

12. The beverage dispenser of claim 1 wherein said means for cooling said mixing liquid is a cold plate disposed at the bottom of said ice storage cavity, said mixing liquid being circuitously routed through said cold plate prior to being dispensed.

13. A beverage dispenser for dispensing a beverage syrup and a mixing liquid at a specified ratio, said beverage dispenser comprising:

an ice bin defining an ice storage cavity, said ice storage cavity comprising a front section and a rear section, said rear section being in communication with said front section;

means for cooling said mixing liquid prior to the dispensing of said mixing liquid, said means for cooling comprising a cold plate having a first predetermined surface area disposed at the bottom of said front section of said ice bin, substantially all of said first predetermined surface area being in communication with said ice storage cavity, said mixing liquid being circuitously routed through said cold plate prior to being dispensed;

at least one shield disposed between said front section and a portion of said rear section;

a cover for isolating said portion of said rear section from said front section, said cover in conjunction with said shield operable to maintain said communication between said first predetermined surface area and said ice storage cavity while reducing the volume of said ice storage cavity.

14. The beverage dispenser of claim 13 wherein said beverage concentrate is circuitously routed through said cold plate prior to being dispensed.

15. The beverage container of claim 13 wherein said at least one shield is held in position by a plurality of flanges extending from the walls of said ice bin into said ice storage cavity.

16. The beverage dispenser of claim 13 wherein said cover is held in position by a plurality of flanges extending from the walls of said ice bin into said ice storage cavity.

17. The beverage dispenser of claim 13 further comprising a door for providing access to said ice storage cavity.

18. The beverage dispenser of claim 13 wherein said ice storage cavity is adapted to mate with an automatic ice maker.

19. A beverage dispenser for dispensing a beverage syrup and a mixing liquid at a specified ratio, said beverage dispenser comprising:

an ice bin defining an ice storage cavity, said ice storage cavity comprising a front section and a rear section, said rear section being in communication with said front section;

means for cooling said mixing liquid prior to the dispensing of said mixing liquid, said means for cooling comprising a cold plate disposed at the bottom of said front section of said ice bin, said mixing liquid being circuitously routed through said cold plate prior to being dispensed;

at least one shield disposed between said front section and a portion of said rear section;

a cover for isolating said portion of said rear section from said front section, said cover being in position by a plurality of flanges extending from the walls of said ice bin into said ice storage cavity.

* * * * *